US010321222B1

(12) United States Patent
Zhou et al.

(10) Patent No.: US 10,321,222 B1
(45) Date of Patent: Jun. 11, 2019

(54) EARPHONE, EARPHONE CONTROL METHOD AND DEVICE

(71) Applicant: BOE TECHNOLOGY GROUP CO., LTD., Beijing (CN)

(72) Inventors: Zhigang Zhou, Beijing (CN); Liang Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/054,771

(22) Filed: Aug. 3, 2018

(30) Foreign Application Priority Data

Jan. 3, 2018 (CN) ..... 2018 1 0005880

(51) Int. Cl.
*G10K 11/16* (2006.01)
*H04R 1/10* (2006.01)
*H04R 1/28* (2006.01)

(52) U.S. Cl.
CPC ..... *H04R 1/1083* (2013.01); *H04R 1/1016* (2013.01); *H04R 1/2869* (2013.01)

(58) Field of Classification Search
CPC ... H04R 1/1083; H04R 1/1016; H04R 1/2869
See application file for complete search history.

(56) References Cited

U.S. PATENT DOCUMENTS

2010/0128887 A1* 5/2010 Lee ..... H04R 1/1041 381/74
2010/0246845 A1* 9/2010 Burge ..... H04R 1/1041 381/71.6
2014/0241553 A1* 8/2014 Tiscareno ..... H04R 1/1016 381/309
2018/0132048 A1* 5/2018 Usher ..... H04R 25/70

FOREIGN PATENT DOCUMENTS

| | | | |
|---|---|---|---|
| CN | 105487899 | A | 4/2016 |
| CN | 105516858 | A | 4/2016 |
| CN | 205647878 | U | 10/2016 |
| CN | 106535024 | A | 3/2017 |
| CN | 107122161 | A | 9/2017 |
| WO | 2017/088166 | A1 | 6/2017 |

OTHER PUBLICATIONS

Office Action, including Search Report, for Chinese Patent Application No. 201810005880.X, dated Feb. 6, 2019, 11 pages.

* cited by examiner

*Primary Examiner* — Andrew L Sniezek
(74) *Attorney, Agent, or Firm* — Westman, Champlin & Koehler, P.A.

(57) ABSTRACT

An earphone, an earphone control method and device are provided, the earphone control device includes an echo collection module, a state determination module and a control module, where the echo collection module includes at least one acoustic sensor, which is arranged in a space defined by an earphone and an ear canal, when the earphone is worn, for collecting a sound in the space, where the echo collection module is configured to collect the sound, convert the sound into a first audio signal, and output the first audio signal to the state determination module; the state determination module is configured to determine a wearing state of the earphone according to the first audio signal; and the control module is configured to perform playing control according to the wearing state of the earphone.

20 Claims, 2 Drawing Sheets

EARPHONE, EARPHONE CONTROL METHOD AND DEVICE

CROSS-REFERENCE TO RELATED APPLICATION

This application claims a priority to Chinese Patent Application No. 201810005880.X filed on Jan. 3, 2018, the disclosure of which is incorporated in its entirety by reference herein.

TECHNICAL FIELD

The present disclosure relates to an electronic device, in particular to an earphone, an earphone control method and device.

BACKGROUND

In daily life, while a user uses an earphone to listen to an audio or a video such as a music and a movie, the user needs to manually manipulate an electronic device. Therefore, user experience needs to be improved.

SUMMARY

According to at least one embodiment of the present disclosure, an earphone control device is provided. The earphone control device includes an echo collection module, a state determination module and a control module. The echo collection module includes at least one acoustic sensor, which is arranged in a space defined by an earphone and an ear canal, when the earphone is worn, for collecting a sound in the space. The echo collection module is configured to collect the sound, convert the sound into a first audio signal, and output the first audio signal to the state determination module. The state determination module is configured to determine a wearing state of the earphone according to the first audio signal, and output the wearing state of the earphone to the control module. The control module is configured to perform playing control according to the wearing state of the earphone.

According to at least one embodiment of the present disclosure, an earphone control method is provided. The method includes:

obtaining a first audio signal output by an echo collection module in an earphone;

determining a wearing state of the earphone according to the first audio signal; and performing playing control according to the wearing state of the earphone, where the echo collection module includes at least one acoustic sensor, which is arranged in a space defined by an earphone and an ear canal, when the earphone is worn, for collecting a sound in the space.

According to at least one embodiment of the present disclosure, an earphone is provided, which includes the earphone control device described above.

BRIEF DESCRIPTION OF THE DRAWINGS

In order to illustrate technical solutions in embodiments of the present disclosure or related art more clearly, the drawings required to be used in description of the embodiments or the related art will be briefly described below. It is clearly that the drawings in the following description are only for some of the embodiments of the present disclosure, and other drawings can also be obtained based on these drawings for those skilled in the art without any inventive labor.

DETAILED DESCRIPTION

To clarify technical problems to be solved by embodiments of the present disclosure, technical solutions and advantages of the present disclosure, detailed descriptions are given based on drawings in conjunction with specific embodiments. It should be noted that, in the case of no conflict, the embodiments and features of the embodiments in the present application may be arbitrarily combined with each other.

Steps illustrated in flowchart of the drawings may be executed in a computer system in form of a set of computer executable instructions, for example. Further, although logical sequences are shown in the flowchart, in some cases, the steps shown or described may be performed in a different order as that described herein.

Unless otherwise defined, technical terms or scientific terms used in the present disclosure shall have common meanings understood by the ordinary skilled in the art. Terms such as "first" and "second" in the present disclosure do not indicate any order, quantity of importance; they are merely used to distinguish different components. Terms such as "include" or "contain" indicate that an element or object before such terms covers an element, an object or the equivalent enumerated after such terms, and do not exclude other elements and objects. Terms such as "coupled" and "connected" are not used to limit physical or mechanical connections, they can be direct or indirect electrical connections. Terms such as "above", "below", "left" and "right" merely indicate relative position relationships; when an absolute position of a described object changes, position relationships with respect to the described object change accordingly.

In daily life, while a user uses an earphone to listen to an audio or a video such as a music and a movie, the earphone may get off from ears for some reasons, such that the user can not listen to the audio or the video, but the audio and the video will continue to play until a player is passively paused. When the user expects to use the player to replay the audio or the video, the user need to find a previous playing position of the audio or the video through rewinding operations several times, which brings inconvenience to the users and causes a bad user experience.

According to at least one embodiment of the present disclosure, it is provided an earphone, an earphone control method and an earphone control device, capable of detecting an earphone wearing state.

Figure 1:
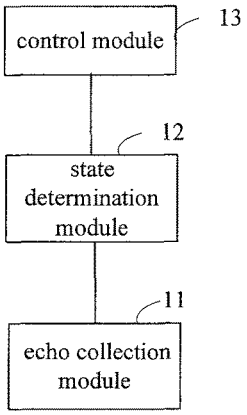
FIG. 1 is a schematic structural diagram of an earphone control device according to at least one embodiment of the present disclosure.

An earphone control device is provided according to at least one embodiment of the present disclosure, as shown in FIG. 1. The earphone control device includes an echo collection module 11, a state determination module 12 and a control module 13, where the echo collection module 11 includes at least one acoustic sensor, which is arranged in a space defined by an earphone and an ear canal, when the earphone is worn, for collecting a sound in the space.

The echo collection module 11 is configured to collect the sound, convert the sound into a first audio signal, and output the first audio signal to the state determination module 12.

The state determination module 12 is configured to determine a wearing state of the earphone according to the first audio signal, and output the wearing state of the earphone to the control module 13.

The control module 13 is configured to perform playing control according to the wearing state of the earphone.

The echo collection module 11 may be configured to collect a sound all the time, or may be configured to start to collect a sound when the earphone control device is activated and stop collecting a sound when the earphone control device is stopped. Further, the echo collection module 11 may collect a sound only when the earphone starts to play. When the earphone is worn, the echo collection module 11 may collect a sound, i.e., an echo, in a closed environment defined by the earphone and the ear canal. When the earphone is not worn, the echo collection module 11 may collect a sound in an open environment. Therefore, a wearing state of the earphone may be determined based on the sound collected by the echo collection module 11. The echo collection module 11 for example may further include a data collection circuit. When the acoustic sensor may convert an acoustic signal into an electrical signal, the data collection circuit may collect the electrical signal and therefore obtain audio data.

In this embodiment, the echo collection module is arranged in the earphone control device, and a first audio signal collected by the echo collection module when the earphone is worn that is different from a first audio signal collected by the echo collection module when the earphone is not worn, a wearing state of the earphone can be determined by the state determination module based on the collected first audio signal, and then the control module can perform playing control based on the wearing state of the earphone. Therefore, the wearing state of the earphone can be detected in real-time, and playing control can be performed accordingly, thereby improving user experience.

In an actual application, the earphone has two states, a playing state and a non-playing state. Operation modes of the earphone control device under the two states will be described below, respectively.

1. The Earphone Currently in a Playing State

In this case, if the earphone is worn, a closed space is defined by the earphone and the ear canal, a phase difference between a first audio signal collected by the echo collection module and a second audio signal currently played by the earphone is smaller; while if the earphone is not worn, a phase difference between a first audio signal collected by the echo collection module and a second audio signal currently played by the earphone is larger, therefore, whether the earphone is worn that can be determined based on a comparison between a first audio signal collected by the echo collection module 11 and a second audio signal currently played by the earphone. In the present application, when it refers that the earphone is worn, it indicates that the earphone is worn correctly; while when it refers that the earphone is not worn, it indicates that the earphone is not worn at all or the earphone is worn incorrectly. In some optional embodiments, the phase difference between the first audio signal collected by the echo collection module and the second audio signal currently played by the earphone can be compared, and when the phase difference is larger than a first preset threshold, it is determined that the earphone is not worn. The first preset threshold can be obtained by performing training and analysis on a large number of samples. The phase difference between the first audio signal collected by the echo collection module and the second audio signal currently played by the earphone may be obtained using related art, for example, the phase difference may be determined based on a distance between a zero crossing of the first audio signal and a zero crossing of the second audio signal.

2. The Earphone Currently in a Non-Playing State

In this case, a loudspeaker module of the earphone still has an output, which is a white noise signal. The loudspeaker module includes an audio processing module and a sounding emitting module. When the earphone is in the non-playing state, a current signal still exists in the audio processing module, and the current signal is the white noise signal. If the earphone is worn, a closed space is defined by the earphone and the ear canal, and then the first audio signal collected by the echo collection module 11 is a white noise signal. If the earphone is not worn, an ambient noise signal is collected by the echo collection module 11. The first audio signal collected by the echo collection module 11 can be compared with the white noise signal output by the earphone. If the phase difference between the first audio signal and the white noise signal is larger than a second preset threshold, it is determined that the earphone is not worn; if the phase difference between the first audio signal and the white noise signal is not larger than the second preset threshold, it is determined that the earphone is worn. The second preset threshold can be obtained by performing training and analysis on a large number of samples. The second preset threshold may be equal to the first preset threshold or may be different from the first preset threshold. Further, when the earphone is currently in a non-playing state, it is also possible to determine whether the earphone is worn based on directly a determination whether the first audio signal is a white noise signal (a power spectral density of the white noise signal is evenly distributed throughout a frequency domain), i.e., it is determined that the earphone is worn when the first audio signal is a white noise signal, and it is determined that the earphone is not worn when the first audio signal is not white noise signal.

Figure 2:
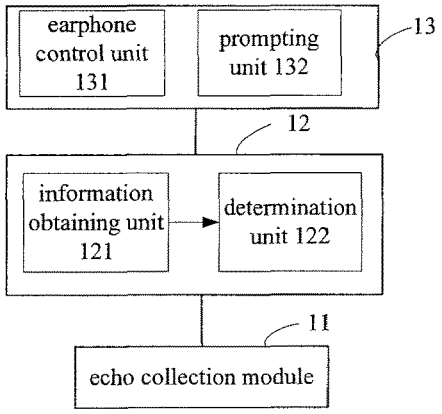
FIG. 2 is a schematic structural diagram of an earphone control device according to at least one embodiment of the present disclosure.

In some optional embodiments, as shown in FIG. 2, the state determination module 12 includes an information obtaining unit 121 and a determination unit 122.

Specifically, the information obtaining unit 121 is configured to obtain the first audio signal collected by the echo collection module 11 and a second audio signal inputted to the earphone. When the earphone is in a playing state, an external audio source inputs an audio signal, i.e., the second audio signal, to the earphone. The external audio source can be an audio output device such as a mobile phone, a tablet, a computer, or a speaker box.

The determining unit 122 is configured to: determine that the wearing state of the earphone is a non-worn state, when the earphone is currently in a playing state and a phase difference between the first audio signal and the second audio signal is larger than a first preset threshold; and determine that the wearing state of the earphone is a worn state, when the earphone is currently in the playing state and the phase difference between the first audio signal and the second audio signal is not larger than the first preset threshold.

In some optional embodiments, the information obtaining unit 121 is configured to obtain the first audio signal collected by the echo collection module 11 and a white noise signal of a loudspeaker module of the earphone. When the earphone is in a non-playing state (i.e., an audio signal input from an external audio source is not played), the loudspeaker module still generates a current signal, which is the white noise signal of the loudspeaker module.

The determining unit 122 is configured to: determine that the wearing state of the earphone is a non-worn state, when the earphone is currently in a non-playing state and a phase difference between the first audio signal and the white noise signal of the loudspeaker module of the earphone is larger than a second preset threshold; and determine that the wearing state of the earphone is a worn state, when the earphone is currently in a non-playing state and a phase difference between the first audio signal and the white noise signal of the loudspeaker module of the earphone is not larger than the second preset threshold.

As shown in FIG. 2, the control module 13 includes an earphone control unit 131 and a prompting unit 132.

Specifically, the earphone control unit 131 is configured to: control a player to pause or stop a currently played audio or video, when the earphone is currently in a playing state and the earphone is not worn; and control the player to automatically play an audio or video, when the earphone is currently in a non-playing state and the earphone is worn.

The prompting unit 132 is configured to output a prompt sound to a loudspeaker module of the earphone, when the earphone is currently in a non-playing and the earphone is not worn. The prompt sound may be a pre-recorded artificial voice such as "whether or not to play", or other prompt sounds, which is not limited in the present application.

In the embodiment, when the earphone is currently in a playing state but the earphone is not worn, the currently playing audio or video may be paused or stopped automatically, which can reduce power consumption on one hand, and the audio or video can be stopped at a position at which the user is currently listening to, so that the user can directly play the audio or video from the stopped position when the user want to listen the audio or video later. However, in the related art, during listening to an audio book, if the user removes the earphone but forgets to pause or stop playing of the audio book, then the audio book will continue to play, the user is required to continuously retreat to try to find a position of the last play when the user replays the audio book later, which brings poor user experience.

In some optional embodiments, the control module 13 may only include the earphone control unit 131 but not the prompting unit 132.

In some optional embodiments, the earphone control unit 131 is further configured to turn off an active noise reduction function of the earphone, when the earphone is currently in a playing state and the earphone is not worn, or when the earphone is currently in a non-playing state, the earphone is not worn and the active noise reduction function of the earphone is turned on. In the embodiment, for the earphone with the active noise reduction function, the active noise reduction function can be actively turn off, when the earphone is currently in a playing state and is not worn. Power consumption of the earphone is larger when the active noise reduction function is turned on. Therefore, the power consumption of the earphone is reduced, when the active noise reduction function is turned off in time, which prolongs the use life of the earphone.

Figure 3:
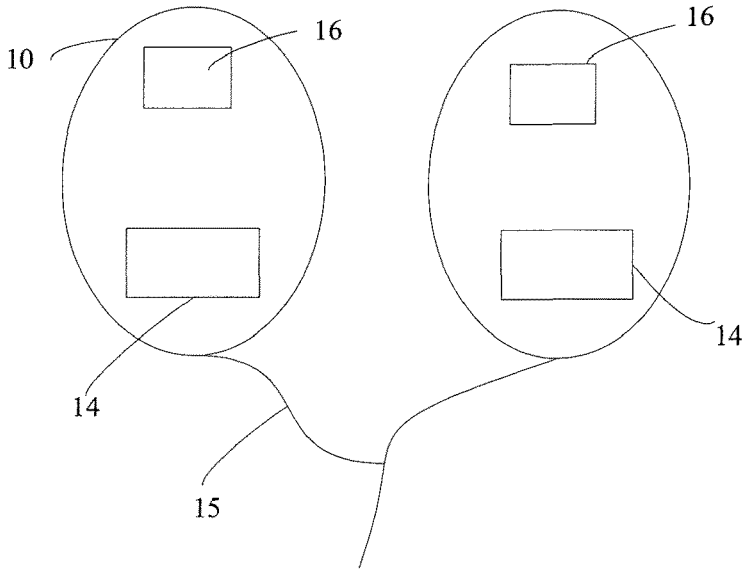
FIG. 3 is a schematic structural diagram of an earphone according to at least one embodiment of the present disclosure.

As shown in FIG. 3, the embodiment provides an earphone including the earphone control device described according to the above embodiments, and the earphone further includes an earphone body 10 (including a left earphone body and a right earphone body), a loudspeaker module 14 and an audio wire 15. An echo collection module 11 may be arranged in the earphone body 10. The earphone body 10 is provided with a via hole 16 for enabling an acoustic sensor of the echo collection module 11 to collect external sound. When the earphone is worn, the via hole 16 faces to a space defined by the earphone and an ear canal. The echo collection module 11 may be provided only in the left earphone body, or the echo collection module 11 may be provided only in the right earphone body, or the echo collection module 11 may be provided in both the left earphone body and the right earphone body. When a wearing state of the earphone is determined, a wearing state of the left earphone body and a wearing state of the right earphone body are respectively determined. When both of the left earphone body and the right earphone body are worn, it is determined that the earphone is worn, and if one of the left earphone body and the right earphone body is not worn, it is determined that the earphone is not worn. Optionally, the echo collection module 11 may be partially arranged within the earphone body 10, and partially arranged on an outer surface of the earphone body 10; or whole of the echo collection module 11 may be arranged on an outer surface of the earphone body.

The earphone shown in FIG. 3 is an earplug type earphone, but the present application is not limited thereto, and the earphone may be an over-ear earphone or a head-mounted headset.

For example, the earphone may be a wired earphone or a wireless earphone, including but not limited to a Bluetooth earphone.

Figure 4:
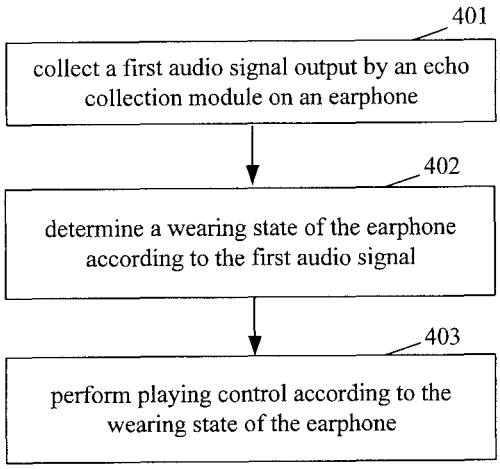
FIG. 4 is a flowchart of an earphone control method according to at least one embodiment of the present disclosure.

The earphone control device may also be partially arranged on the earphone, and partially arranged on a playing device. For example, the echo collection module 11 is arranged on the earphone, the state determining module 12 and the control module 13 are arranged on the playing device; or the echo collection module 11 and the state determining module 12 are arranged on the earphone, and the control module 13 is arranged on the playing device. The state determining module 12 and the control module 13 can be implemented based on software or hardware. When implemented based on software, the state determining module 12 and the control module 13 may be used as a built-in function of the system of the playback device. At least one embodiment provides an earphone control method, as shown in FIG. 4, including step 401, step 402 and step 403.

In step 401, a first audio signal output by an echo collection module on the earphone is obtained.

In step 402, a wearing state of the earphone is determined according to the first audio signal.

In step 403, playing control is performed according to the wearing state of the earphone, where the echo collection module includes at least one acoustic sensor, and the at least one sound sensor is arranged in a space defined by the earphone and the ear canal when the earphone is worn, for collecting a sound in the space.

In an embodiment, a closed space is defined by the earphone and the ear canal, when the earphone is worn. Due to the closed space, a phase difference between a first audio signal collected by the echo collection module and a second audio signal played in the earphone is smaller. When the earphone is not worn, the phase difference between the first audio signal and the second audio signal is larger. Therefore, the wearing state of the earphone can be determined by the phase difference and therefore playing control can be performed based on the wearing state. Specifically, the determining the wearing state of the earphone according to the first audio signal includes:

when the earphone is currently in a playing state, and the phase difference between the first audio signal and the second audio signal input to the earphone is larger than a first preset threshold, determining that the wearing state of the earphone is a non-warn state; or when the earphone is currently in a non-playing state, and the phase difference between the first audio signal and the white noise signal of the loudspeaker module of the earphone is not larger than a second preset threshold, determining that the wearing state of the earphone in a worn state.

In some optional embodiments, in the step 403, the performing playing control according to the wearing state of the earphone includes: controlling the player to pause or stop the currently playing audio or video, when the earphone is currently in a playing state and the earphone is not worn.

In some optional embodiments, in the step 403, the performing playing control according to the wearing state of the earphone includes: controlling the player to automatically play an audio or video or controlling the earphone to output a prompt sound, when the earphone is currently in a non-playing state and the earphone is worn. That is, when the earphone is currently in a non-playing state, but the earphone is worn, the audio or video is automatically played at this time, or the user is prompted to play the audio or video.

In the solution provided according to the embodiment, the audio or video may be paused or stopped when the earphone is not worn. Compared with the related art, when the user does not pause or stop playing the audio or video in time, the user needs to search again the previous listening or viewing position if the user wants to listen or view the audio or video later. However, in the present application, the audio or video is stopped at the previous listening or viewing position, thereby improving the user experience. In addition, since the audio or video may be paused or stopped in time, the power consumption of the playing device is reduced.

In the related art, when an earphone with an active noise reduction function is used, if the earphone is not worn but still in a playing state, the active noise reduction function of the earphone will work until the battery is exhausted or the user actively turns off the active noise reduction function, which is not beneficial to save the power consumption of the earphone with the active noise reduction function, therefore, it is necessary to turn off the active noise reduction function in time. In an embodiment of the present application, if the earphone is an earphone with an active noise reduction function, in step 403, the performing play control according to the wearing state of the earphone includes: when the earphone is currently in a playing state and the earphone is not worn, turning off the active noise reduction function of the earphone. In the embodiment, the active noise reduction function of the earphone may be turned off in time after the earphone is taken off, thereby reducing the power consumption of the earphone.

In some optional embodiments, in the step 403, the performing play control according to the wearing state of the earphone includes: when the earphone is currently in a non-playing state and the earphone is not worn and the active noise reduction function of the earphone is turned on, the active noise reduction function of the earphone is turned off. For example, if the user accidentally turns on the active noise reduction function and does not actively turn off the active noise reduction function, the active noise reduction function can be automatically turned off at this time.

Figure 5:
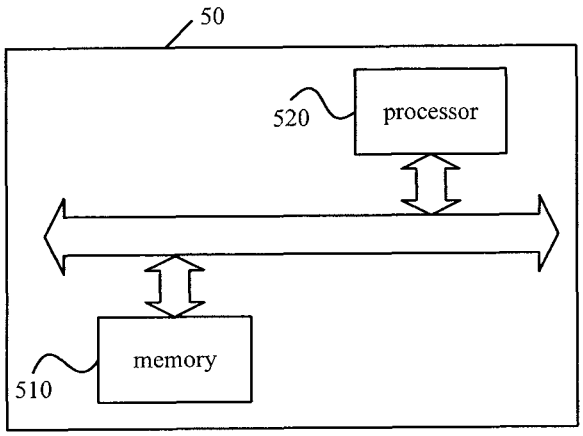
FIG. 5 is a block diagram of an earphone control device according to at least one embodiment of the present disclosure.

At least one embodiment of the present disclosure provides an earphone control device 50. As shown in FIG. 5, the earphone control device includes a memory 510 and a processor 520. The memory 510 stores a program, when read and executed by the processor 520, an earphone control method according to any of the embodiments described above is implemented. The memory 510 may be a medium in which the program is stored, such as a U disk, a Read-Only Memory (ROM), a Random Access Memory (RAM), a removable hard disk, a magnetic disk, or an optical disk, and the like. The processor 520 may be a central processing unit (CPU), a digital signal processing (DSP) chip, a field programmable gate array (FPGA) chip, a programmable logic controller (PLC), and the like.

The earphone control device may be arranged an earphone or may be arranged on a playback device.

At least one embodiment of the present disclosure also provides a computer readable storage medium, on which storing at least one program executable by at least one processor to implement an earphone control method in any one of the embodiments described above.

The computer readable storage medium includes a medium in which the program is stored, such as a U disk, a Read-Only Memory (ROM), a Random Access Memory (RAM), a removable hard disk, a magnetic disk, or an optical disk, and the like.

Optional embodiments are described hereinabove. It should be noted that, various improvements and polishment can be made by those ordinary skilled in the art without departing from the principle of the present disclosure, and those improvements and polishment fall within the protection scope of the present disclosure.

What is claimed is:

1. An earphone control device, comprising an echo collection module, a state determination module and a control module, wherein the echo collection module comprises at least one acoustic sensor, which is arranged in a space defined by an earphone and an ear canal, when the earphone is worn, for collecting a sound in the space, wherein the echo collection module is configured to collect the sound, convert the sound into a first audio signal, and output the first audio signal to the state determination module;

the state determination module is configured to determine a wearing state of the earphone according to the first audio signal, and output the wearing state of the earphone to the control module; and the control module is configured to perform playing control according to the wearing state of the earphone, wherein the state determination module comprises an information obtaining unit and a determination unit;

wherein the information obtaining unit is configured to obtain the first audio signal and a second audio signal inputted to the earphone, when the earphone is in a playing state; and wherein the determination unit is configured to: determine that the wearing state of the earphone is a non-worn state, in a case that a phase difference between the first audio signal and the second audio signal is larger than a first threshold when the earphone is in the playing state; and determine that the wearing state of the earphone is a worn state, in a case that the phase difference between the first audio signal and the second audio signal is not larger than the first threshold when the earphone is in the playing state.

2. The earphone control device according to claim 1, wherein the information obtaining unit is further configured to obtain the first audio signal and a white noise signal of a loudspeaker module of the earphone, when the earphone is in a non-playing state; and wherein the determination unit is configured to: determine that the wearing state of the earphone is a non-worn state, in a case that the white noise signal of the loudspeaker module of the earphone is larger than a second threshold when the earphone is in the non-playing state; and determine that the wearing state of the earphone is a worn state, in a case that a phase difference between the first audio signal and the white noise signal of the loudspeaker module of the earphone is not larger than the second threshold when the earphone is in the non-playing state.

3. The earphone control device according to claim 1, wherein the control module comprises an earphone control unit and a prompting unit;

wherein the earphone control unit is configured to: control a player to pause or stop a currently played audio or video, when the earphone is currently in a playing state and the earphone is not worn, and control the player to automatically play the audio or video when the earphone is currently in a non-playing state and the earphone is worn; and wherein the prompting unit is configured to output a prompt sound to a loudspeaker module of the earphone, when the earphone is currently in the non-playing state and the earphone is not worn.

4. The earphone control device according to claim 3, wherein the earphone control unit is further configured to turn off an active noise reduction function of the earphone, when the earphone is currently in the playing state and the earphone is not worn, or when the earphone is currently in the non-playing state, the earphone is not worn, and the active noise reduction function of the earphone is turned on.

5. The earphone control device according to claim 3, wherein the prompt sound is a pre-recorded artificial voice for prompting a user whether the audio or video is required to be played.

6. The earphone control device according to claim 1, wherein when the earphone is worn, a closed space is defined by the earphone and the ear canal, an echo in the closed space is collected by the echo collection module; and when the earphone is not worn, a noise from an open environment surrounding the earphone is collected by the echo collection module.

7. A earphone, comprising an earphone control device according to claim 1, an earphone body and a loudspeaker module, wherein an acoustic sensor of the echo collection module is arranged on a via hole of the earphone body, and the via hole is arranged facing to the space defined by the earphone and the ear canal, when the earphone is worn.

8. The earphone according to claim 7, wherein the earphone body comprises a left earphone body and a right earphone body, the echo collection module is arranged on at least one of the left earphone body or the right earphone body.

9. The earphone according to claim 8, wherein in determining a wearing state, the earphone control device is configured to:

determine a wearing state of the left earphone body and a wearing state of the right earphone body, respectively; and determine the earphone to be in a worn state, in a case that each of the wearing state of the left earphone body and the wearing state of the right earphone body is in the worn state, and determine the earphone to be in a non-worn state, in a case that at least one of the wearing state of the left earphone body and the wearing state of the right earphone body is in the non-worn state.

10. An earphone control method, comprising:

obtaining a first audio signal output by an echo collection module in an earphone;

determining a wearing state of the earphone according to the first audio signal; and performing playing control according to the wearing state of the earphone, wherein the echo collection module comprises at least one acoustic sensor, which is arranged in a space defined by an earphone and an ear canal, when the earphone is worn, for collecting a sound in the space, wherein the determining the wearing state of the earphone according to the first audio signal comprises:

determining that the wearing state of the earphone is a non-worn state, in a case that a phase difference between the first audio signal and a second audio signal inputted to the earphone is larger than a first threshold when the earphone is in a playing state; and determining that the wearing state of the earphone is a worn state, in a case that the phase difference between the first audio signal and the second audio signal is not larger than the first threshold when the earphone is in the playing state.

11. The earphone control method according to claim 10, wherein the determining the wearing state of the earphone according to the first audio signal further comprises:

determining that the wearing state of the earphone is a non-worn state, in a case that a white noise signal of a loudspeaker module of the earphone is larger than a second threshold when the earphone is in a non-playing state; and determining that the wearing state of the earphone is a worn state, in a case that a phase difference between the first audio signal and the white noise signal of the loudspeaker module of the earphone is not larger than the second threshold when the earphone is in the non-playing state.

12. The earphone control method according to claim 10, wherein the performing playing control according to the wearing state of the earphone comprises at least one of:

controlling a player to pause or stop a currently played audio or video, when the earphone is currently in a playing state and the earphone is not worn;

turning off an active noise reduction function of the earphone, when the earphone is currently in the playing state and the earphone is not worn;

controlling the player to automatically play an audio or video or outputting a prompt sound to a loudspeaker module of the earphone, when the earphone is currently in a non-playing state and the earphone is worn; or turning off the active noise reduction function of the earphone, when the earphone is currently in the non-playing state, the earphone is not worn, and the active noise reduction function of the earphone is turned on.

13. The earphone control method according to claim 12, wherein the prompt sound is a pre-recorded artificial voice for prompting a user whether an audio or video is required to be played.

14. The earphone control method according to claim 10, wherein when the earphone is worn, a closed space is defined by the earphone and the ear canal, an echo in the closed space is collected by the echo collection module; and when the earphone is not worn, a noise from an open environment surrounding the earphone is collected by the echo collection module.

15. An earphone control device, comprising an echo collection module, a state determination module and a control module, wherein the echo collection module comprises at least one acoustic sensor, which is arranged in a space defined by an earphone and an ear canal, when the earphone is worn, for collecting a sound in the space, wherein the echo collection module is configured to collect the sound, convert the sound into a first audio signal, and output the first audio signal to the state determination module;

the state determination module is configured to determine a wearing state of the earphone according to the first audio signal, and output the wearing state of the earphone to the control module; and the control module is configured to perform playing control according to the wearing state of the earphone, wherein the state determination module comprises an information obtaining unit and a determination unit;

wherein the information obtaining unit is configured to obtain the first audio signal and a white noise signal of a loudspeaker module of the earphone, when the earphone is in a non-playing state; and wherein the determination unit is configured to: determine that the wearing state of the earphone is a non-worn state, in a case that the white noise signal of the loudspeaker module of the earphone is larger than a first threshold when the earphone is in the non-playing state; and determine that the wearing state of the earphone is a worn state, in a case that a phase difference between the first audio signal and the white noise signal of the loudspeaker module of the earphone is not larger than the first threshold when the earphone is in the non-playing state.

16. The earphone control device according to claim 15, wherein the information obtaining unit is further configured to obtain the first audio signal and a second audio signal inputted to the earphone, when the earphone is in a playing state; and wherein the determination unit is further configured to: determine that the wearing state of the earphone is a non-worn state, in a case that a phase difference between the first audio signal and the second audio signal is larger than a second threshold when the earphone is in the playing state; and determine that the wearing state of the earphone is a worn state, in a case that the phase difference between the first audio signal and the second audio signal is not larger than the second threshold when the earphone is in the playing state.

17. The earphone control device according to claim 15, wherein the control module comprises an earphone control unit and a prompting unit;

wherein the earphone control unit is configured to: control a player to pause or stop a currently played audio or video, when the earphone is currently in a playing state and the earphone is not worn, and control the player to automatically play the audio or video when the earphone is currently in a non-playing state and the earphone is worn; and wherein the prompting unit is configured to output a prompt sound to a loudspeaker module of the earphone, when the earphone is currently in the non-playing state and the earphone is not worn.

18. The earphone control device according to claim 17, wherein the earphone control unit is further configured to turn off an active noise reduction function of the earphone, when the earphone is currently in the playing state and the earphone is not worn, or when the earphone is currently in the non-playing state, the earphone is not worn, and the active noise reduction function of the earphone is turned on.

19. The earphone control device according to claim 17, wherein the prompt sound is a pre-recorded artificial voice for prompting a user whether the audio or video is required to be played.

20. The earphone control device according to claim 15, wherein when the earphone is worn, a closed space is defined by the earphone and the ear canal, an echo in the closed space is collected by the echo collection module; and when the earphone is not worn, a noise from an open environment surrounding the earphone is collected by the echo collection module.

* * * * *